US008672316B2

(12) United States Patent
Chiwata

(10) Patent No.: US 8,672,316 B2
(45) Date of Patent: Mar. 18, 2014

(54) PAPER SHEET SEASONING APPARATUS AND IMAGE FORMING APPARATUS

(75) Inventor: Yuhei Chiwata, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 196 days.

(21) Appl. No.: 13/365,269

(22) Filed: Feb. 3, 2012

(65) Prior Publication Data

US 2012/0224902 A1 Sep. 6, 2012

(30) Foreign Application Priority Data

Mar. 1, 2011 (JP) ..... 2011-043993

(51) Int. Cl.
*B65H 1/00* (2006.01)
*B65H 31/00* (2006.01)

(52) U.S. Cl.
USPC ..... 271/161; 271/209; 271/211

(58) Field of Classification Search
USPC ..... 271/161, 209, 211, 220; 399/92, 405
See application file for complete search history.

(56) References Cited

U.S. PATENT DOCUMENTS

| | | | | |
|---|---|---|---|---|
| 2003/0107166 | A1* | 6/2003 | Cost et al. | 271/177 |
| 2008/0191410 | A1* | 8/2008 | Shinohara | 271/209 |
| 2010/0295240 | A1* | 11/2010 | Brewer et al. | 271/220 |
| 2011/0012973 | A1 | 1/2011 | Chiwata | |
| 2012/0242035 | A1* | 9/2012 | Yoshida | 271/220 |

FOREIGN PATENT DOCUMENTS

| | | |
|---|---|---|
| JP | 2008-290800 A | 12/2008 |
| JP | 2010-247912 | 11/2010 |
| JP | 2011-20376 | 2/2011 |

OTHER PUBLICATIONS

Partial English Language translation of the following: Office action dated Jan. 29, 2013 from the Japanese Patent Office in a Japanese patent application corresponding to the instant patent application. This office action translation is submitted now in order to supplement the understanding of patent document JP 2011-20376 and JP2010-247912 which are cited in the office action and are being disclosed in the instant Information Disclosure Statement.

* cited by examiner

*Primary Examiner* — David H Bollinger
(74) *Attorney, Agent, or Firm* — SOLARIS Intellectual Property Group, PLLC

(57) ABSTRACT

A paper sheet seasoning apparatus includes a mount on which a plurality of sheet-like recording media are loaded. A central portion of the mount is curved in a convex shape when seen in a first direction. The apparatus also includes a blowing member that blows air in the first direction onto end portions of the recording media loaded on the mount. The apparatus further includes a pair of side panels that support both end portions in a direction that intersects the first direction of the recording media on the mount, and a top panel disposed with a gap in a vertical direction between the top panel and the uppermost recording medium on the mount. On at least one of the side panels, there is disposed an approaching surface that approaches the opposing side panel as the approaching surface heads upward in the vertical direction.

9 Claims, 9 Drawing Sheets

PAPER SHEET SEASONING APPARATUS AND IMAGE FORMING APPARATUS

CROSS-REFERENCE TO RELATED APPLICATION

This application claims priority under 35 USC 119 from Japanese Patent Application No. 2011-043993 filed on Mar. 1, 2011, the disclosure of which is incorporated by reference herein.

BACKGROUND OF THE INVENTION

1. Technical Field

The present invention relates to a paper sheet seasoning apparatus and an image forming apparatus.

2. Related Art

In Japanese Patent Application Laid-Open (JP-A) No. 2008-290800, there is described a paper separating device that sorts a plurality of stacked paper sheets in such a way that it is easy to separate the paper sheets without relying on human hands, irrespective of the size and number of the paper sheets.

A pair of holding members that hold the front surfaces of the paper sheets (recording medium) from both sides are disposed in this separating device. The holding members are configured from two flat panel portions and have concave shapes with respect to the paper sheets.

SUMMARY

However, in the related art, effectively introducing air between the paper sheets is not taken into consideration in a case where the thickness of the recording medium is thick (in other word, in the case of thick paper where the rigidity of the recording medium is high).

It is a subject of the present invention to effectively send, even in a case where loaded recording media are thick paper whose rigidity is high, air between the recording media.

A paper sheet seasoning apparatus pertaining to a first aspect of the present invention includes: a mount on which plural sheet-like recording media on which images have been formed are loaded and whose central portion is curved in a convex shape when seen from a first direction; a blowing member that blows air in the first direction onto end portions of the recording media loaded on the mount; a pair of side panels that support both end portions, in a direction that intersects the first direction, of the recording media loaded on the mount; and a top panel that is disposed in such a way that a gap exists in a vertical direction between the top panel and an uppermost recording medium loaded on the mount. On at least one of the pair of the side panels, there is disposed an approaching surface that approaches the opposing side panel as the approaching surface heads upward in the vertical direction.

According to this configuration, the central portion of the mount on which are plurally loaded the sheet-like recording media on which images have been formed is curved in a convex shape when seen from the first direction. Additionally, the blowing member blows air in the first direction onto the end portions of the recording media loaded on the mount.

Because the central portion of the mount is curved in a convex shape, even in a case where end regions in the first direction of the recording media is curled strong, curled end regions of the recording media are regulated to be flat with respect to the air blowing direction, and the air can stably pass between the recording media.

Moreover, the pair of side panels support both end portions in the direction intersecting the first direction of the recording media loaded on the mount, and the top panel is disposed in such a way that a gap exists in a vertical direction between the top panel and the uppermost recording medium loaded on the mount.

On at least one of the pair of the side panels, there is disposed the approaching surface that approaches the opposing side panel as the approaching surface heads up in the vertical direction.

By disposing the approaching surface on at least one of the pair of the side panels in such a way that the approaching surface approaches the opposing side panel, even in a case where the loaded recording media is thick paper whose rigidity is high, the end portions of the recording media (thick paper) in the direction intersecting the first direction are pressed by the approaching surface while the recording media have been raised as a result of air being blown thereon by the blowing member. Because the end portions of the raised recording media are pressed by the approaching surface, the recording media bend in such a way that their central portions become convex when seen in the first direction. Because of this, gaps arise between the recording media, and air can be effectively sent between the recording media even in a case where the loaded recording medium is thick paper whose rigidity is high.

In a paper sheet seasoning apparatus of a second aspect of the present invention, in the first aspect, the approaching surface may be disposed on each of the pair of the side panel.

According to this configuration, the approaching surface is disposed both of the pair of the side panel, the recording media, which have been raised as a result of air being blown thereon, can be effectively caused to bend in such a way that their central portions become convex when the recording media are seen in the first direction.

In a paper sheet seasoning apparatus of a third aspect of the present invention, in the first aspect or the second aspect, the approaching surface may be an inclining surface that inclines with respect to the vertical direction.

According to this configuration, since the approaching surface is an inclining surface that inclines with respect to the vertical direction, the approaching surface can be configured easily.

In a paper sheet seasoning apparatus of a fourth aspect of the present invention, in the third aspect, the angle of inclination of the inclining surface may be adjustable.

According to this configuration, the angle of inclination of the inclining surface can be changed as needed.

In a paper sheet seasoning apparatus of a fifth aspect of the present invention, in the fourth aspect, the paper sheet seasoning apparatus may further include a controller that may control the angle of inclination of the inclining surface on the basis of the thickness of the recording media.

According to this configuration, the angle of inclination of the inclining surface can be changed on the basis of the thickness of the recording media.

In a paper sheet seasoning apparatus of a sixth aspect of the present invention, in the first aspect, in a case where the thickness of the recording media is thick, the controller may increase the angle of inclination of the inclining surface compared to a case where the thickness of the recording media is thin.

According to this configuration, even in the case that the recording media is thick paper and whose rigidity is high, the recording media, which have been raised as a result of air being blown thereon, can be effectively caused to bend in such a way that their central portions become convex when the recording media are seen in the first direction.

In a paper sheet seasoning apparatus of a seventh aspect of the present invention, in any of the third to sixth aspects, the inclining surface may be disposed on an upper side of the side panel in the vertical direction.

According to this configuration, the inclining surface is disposed on a region of the side panel that supports both end portions of the recording media positioned at the upper side in the loaded recording media.

Here, the recording media positioned at the lower side in the loaded recording media are pressed against the mount, which is curved in a convex shape, and bend because the weight of the other recording media loaded thereon. On the other hand, the recording media positioned at the upper side in the loaded recording media are not pressed against the mount because the load of the weight from the other recording media is small compared to the recording media positioned at the lower side, and there are cases where the recording media positioned at the upper side is not sufficiently bent (there are cases where the recording media positioned at the upper side are taught due to the rigidity of the paper sheets).

However, as mentioned above, the end portions of the recording media that have been raised as a result of air being blown thereon by the blowing member are pressed by the inclining surface. Accordingly, the recording media is bent in such a way that their central portions become convex when seen from the first direction. In this way, the recording media positioned at the upper side in the loaded recording media can be effectively caused to bend.

In a paper sheet seasoning apparatus of an eighth aspect of the present invention, in the third aspect, the inclining surface may be formed on an attachable-and-detachable member that is disposed in such a way as to be attachable to and detachable from the side panel.

According to this configuration, the attachable-and-detachable member having the inclining surface can be attached as needed to the side panel.

An image forming apparatus of a ninth aspect of the present invention includes: an image recording section that forms images on recording media; and the paper sheet seasoning apparatus according to any one of the first to eighth aspects that receives the recording media on which images have been formed in the image recording section.

According to this configuration, the image forming apparatus is equipped with the paper sheet seasoning apparatus that receives the recording media on which images have been formed in the image recording section, deformation of the recording media that have been outputted can be suppressed.

According to the present invention, even in a case where loaded recording media are thick paper whose rigidity is high, air can be effectively sent between the recording media.

BRIEF DESCRIPTION OF THE DRAWINGS

Embodiments of the present invention will be described in detail based on the following figures, wherein.

DETAILED DESCRIPTION OF THE INVENTION

Figure 1A:
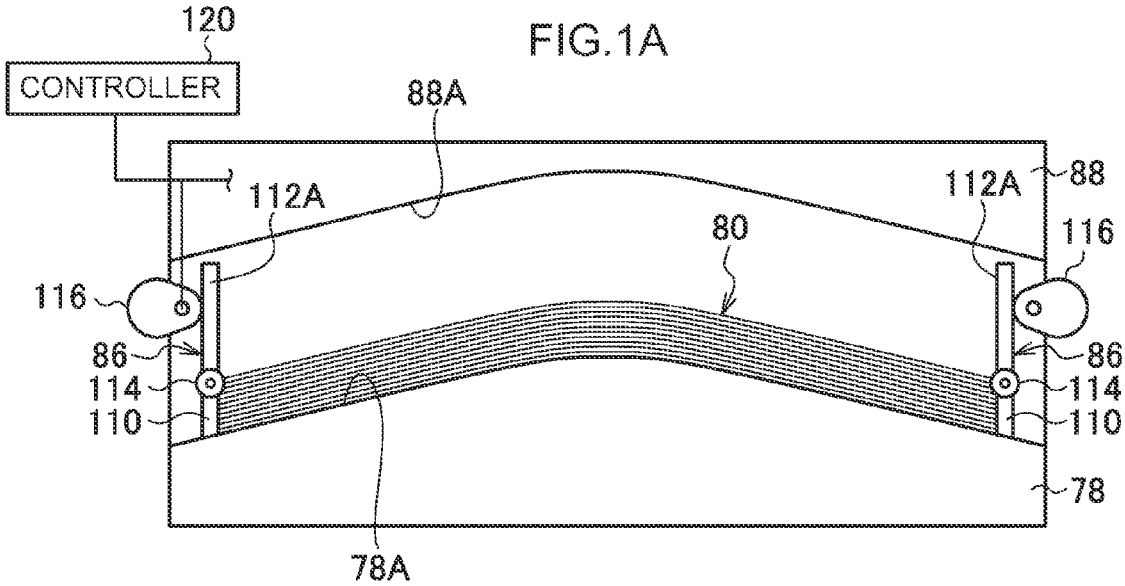
FIG. 1A, FIG. 1B, and FIG. 1C are front views showing a seasoning apparatus pertaining to a first embodiment of the present invention.

An example of a seasoning apparatus 58 and an image forming apparatus 10 pertaining to a first embodiment of the present invention will be described in accordance with FIG. 1A to FIG. 8. Arrow UP in the drawings indicates up in a vertical direction.

(Overall Configuration)

Figure 8:
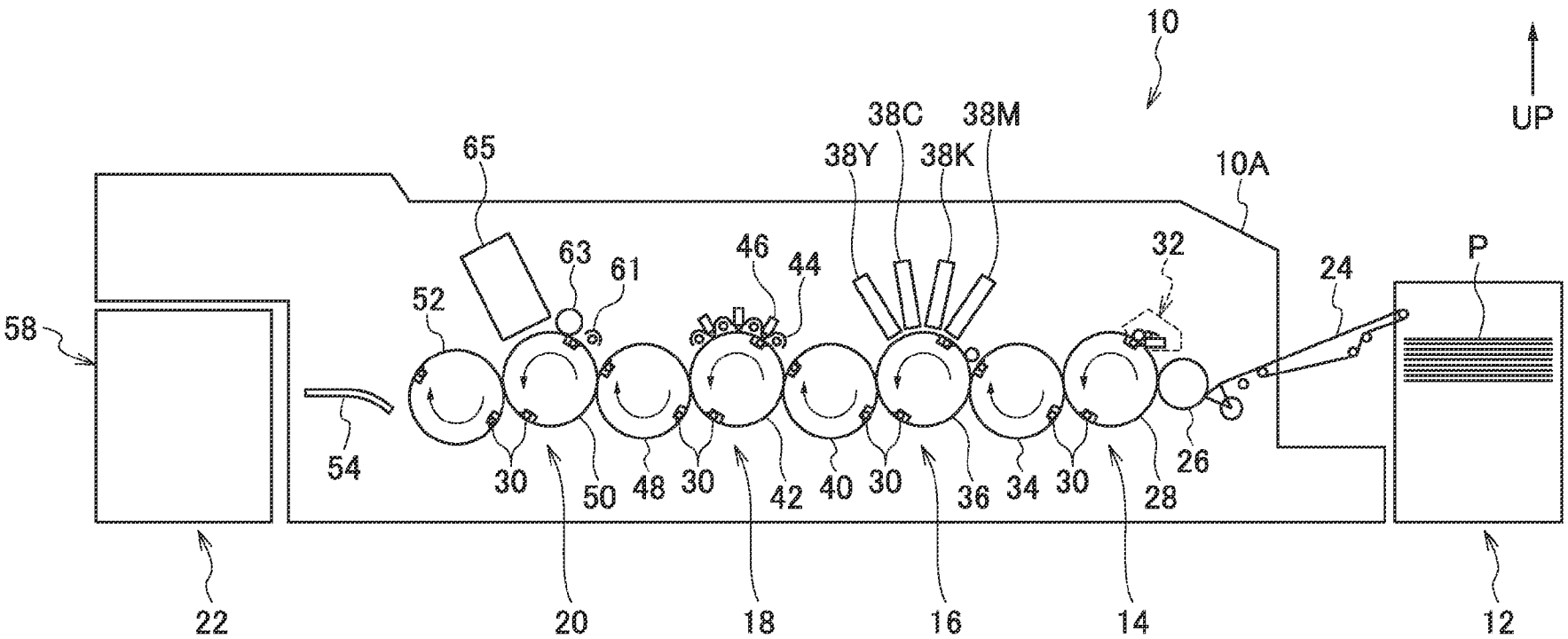
FIG. 8 is a schematic configuration diagram showing an image forming apparatus using the seasoning apparatus pertaining to the first embodiment of the present invention.

As shown in FIG. 8, the image forming apparatus 10 is equipped with a paper supplying section 12 that supplies paper sheets P serving as an example of recording media to an apparatus body 10A, a process liquid applying section 14 that applies a process liquid to image forming surfaces of the paper sheets P, an image recording section 16 that forms images on the paper sheets P, a drying section 18 that decreases (dries) the moisture in the paper sheets P in order to strengthen the film properties of drawn portions of the paper sheets P on which the images have been formed, a fixing section 20 that fixes to the paper sheets P the images that have been formed, and a discharging section 22 to which the paper sheets P are discharged.

The paper sheets P are loaded in the paper supplying section 12, and the paper supplying section 12 sends out the paper sheets P one sheet at a time to the apparatus body 10A. Moreover, a paper supplying tray 24 that guides the paper sheet P that has been sent out from the paper supplying section 12 toward the apparatus body 10A is disposed on the downstream side in the conveyance direction of the paper sheets P (hereinafter simply called "the downstream side") with respect to the paper supplying section 12. Further, on the downstream side of the paper supplying tray 24, a paper supplying drum 26 that rotates and conveys the paper sheet P along the outer peripheral surface of the paper supplying drum 26 is disposed inside the apparatus body 10A. The paper sheet P is conveyed by the paper supplying drum 26 to the process liquid applying section 14.

Moreover, a process liquid applying drum 28 is disposed in the process liquid applying section 14. The processing liquid applying drum 28 rotates, receives the paper sheet P that has been conveyed by the paper supplying drum 26, and conveys the paper sheet P along the outer peripheral surface of the process liquid applying drum 28. Specifically, a holding member 30 that holds the leading end portion of the paper sheet P is disposed on the outer peripheral surface of the process liquid applying drum 28. Because of this configuration, the paper sheet P is conveyed to the downstream side by the rotation of the process liquid applying drum 28 in a state where the leading end of the paper sheet P is held by the holding member 30. The holding member 30 is likewise disposed on a conveying drum 34, an image recording drum 36, a conveying drum 40, a drying drum 42, a conveying drum 48, a fixing drum 50, and a discharging drum 52 that will be described below.

Further, a process liquid applying device 32 that applies a process liquid to the image forming surface of the paper sheet P conveyed by the process liquid applying drum 28 is disposed on the upper portion of the process liquid applying drum 28. The process liquid has the effect of reacting with liquid droplets described below, causing color materials (pigments) to aggregate, and promoting separation of the color materials (pigments) and a solvent.

Moreover, a conveying drum 34 that rotates, receives the paper sheet P that has been conveyed by the process liquid applying drum 28, and conveys the paper sheet P toward the image recording section 16 is disposed on the downstream side of the process liquid applying drum 28.

Further, an image recording drum 36 that rotates, receives the paper sheet P that has been conveyed by the conveying drum 34, and conveys the paper sheet P along the outer peripheral surface of the image recording drum 36 is disposed in the image recording section 16. Moreover, liquid droplet jetting heads 38 that form an image on the paper sheet P by jetting liquid droplets of ink or the like onto the paper sheet P conveyed by the image recording drum 36 are disposed above the image recording drum 36. The liquid droplet jetting heads 38 are so-called full-line heads that have an ink jetting range corresponding to the maximum width of the paper sheet P. In the present embodiment, as an example, liquid droplet jetting heads 38 of the four colors of yellow (Y), magenta (M), cyan (C), and black (K), which are basic colors, are placed along the circumferential direction of the image recording drum 36.

Moreover, a conveying drum 40 that receives the paper sheet P that has been conveyed by the image recording drum 36 and conveys the paper sheet P toward the drying section 18 is disposed on the downstream side of the image recording drum 36.

Further, a drying drum 42 that rotates, receives the paper sheet P that has been conveyed by the conveying drum 40, and conveys the paper sheet P along the outer peripheral surface of the drying drum 42 is disposed in the drying section 18. Additionally, halogen heaters 44 and warm air nozzles 46 serving as an example of drying means are placed above the drying drum 42. As the paper sheet P is conveyed by the drying drum 42, the moisture included in the paper sheet P is decreased (dried) by heat from the halogen heaters 44 and warm air from the warm air nozzles 46 in order to strengthen the film properties of the drawn portion on which the image has been formed. Because of this, the film property strength of the image that has been formed on the paper sheet P improves.

Moreover, a conveying drum 48 that receives the paper sheet P that has been conveyed by the drying drum 42 and conveys the paper sheet P toward the fixing section 20 is disposed on the downstream side of the drying drum 42.

Further, a fixing drum 50 that rotates, receives the paper sheet P that has been conveyed by the conveying drum 48, and conveys the paper sheet P along the outer peripheral surface of the fixing drum 50 is disposed in the fixing section 20. Moreover, a halogen heater 61 for heating (preliminary heating), a fixing roller 63 that presses the paper sheet P against the fixing drum 50, and an in-line sensor 65 that measures a check pattern on the paper sheet P, the moisture content, the front surface temperature, and the glossiness and so forth of the paper sheet P are disposed in such a way as to oppose the outer peripheral surface of the drying drum 50.

Additionally, a discharging drum 52 that rotates, receives the paper sheet P that has been conveyed by the fixing drum 50, and discharges the paper sheet P to the outside of the apparatus body 10A is disposed on the downstream side of the fixing drum 50.

Further, a guide plate 54 formed in a curved shape that guides the paper sheet P to the outside of the apparatus body 10A is disposed on the downstream side of the discharging drum 52.

Moreover, the paper sheet P that has been discharged to the outside of the apparatus body 10A by the discharging drum 52 is conveyed to a seasoning apparatus 58 disposed in the discharging section 22. Details regarding the seasoning apparatus 58 will be described below.

Because of the above configuration, as shown in FIG. 8, the paper sheet P that has been supplied from the paper supplying section 12 is conveyed along the outer peripheral surfaces of the paper supplying drum 26 and the process liquid applying drum 28 that rotate. In the process liquid applying section 14, the process liquid applying device 32 applies the process liquid to the image forming surface of the paper sheet P conveyed along the outer peripheral surface of the process liquid applying drum 28.

Moreover, the paper sheet P to which the process liquid has been applied is delivered to the conveying drum 34 and is conveyed along the outer peripheral surfaces of the conveying drum 34 and the image recording drum 36 that rotate. In the image recording section 16, the liquid droplet jetting heads 38 of each color form an image on the paper sheet P by jetting liquid droplets of ink or the like onto the image forming surface of the paper sheet P conveyed by the image recording drum 36.

Further, the paper sheet P on whose image forming surface the image has been formed is delivered to the conveying drum 40 and is conveyed along the outer peripheral surfaces of the conveying drum 40 and the drying drum 42 that rotate. In the drying section 18, the paper sheet P conveyed by the drying drum 42 is dried by the heat of the halogen heaters 44 and the warm air blown out from the warm air nozzles 46. That is, the moisture included in the paper sheet P decreases (dries), whereby the film properties of the drawn portion where the image has been formed are strengthened.

Then, the paper sheet P that has been warmed to a high temperature by the heat of the halogens heaters 44 and the warm air blown out from the warm air nozzles 46 is delivered to the conveying drum 48 and is conveyed along the outer peripheral surfaces of the conveying drum 48 and the fixing drum 50 that rotate. In the fixing section 20, the halogen heater 61 disposed opposing the fixing drum 50 uses heat to fix the image to the paper sheet P. Moreover, the paper sheet P conveyed by the fixing drum 50 is pressed against the fixing drum 50 by the fixing roller 63 and passes through the portion where the in-line sensor 65 opposes the fixing drum 50. The in-line sensor 65 measures a check pattern on the passing paper sheet P, the moisture content, the front surface temperature, and the glossiness and so forth of the paper sheet P.

Further, the paper sheet P that has been measured by the in-line sensor 65 is delivered to the discharging drum 52, is further guided to the guide plate 54 via the discharging drum 52 that rotates, and is discharged to the seasoning apparatus 58 placed in the discharging section 22 outside the apparatus body 10A.

Next, the seasoning apparatus 58 will be described.

Figure 5:
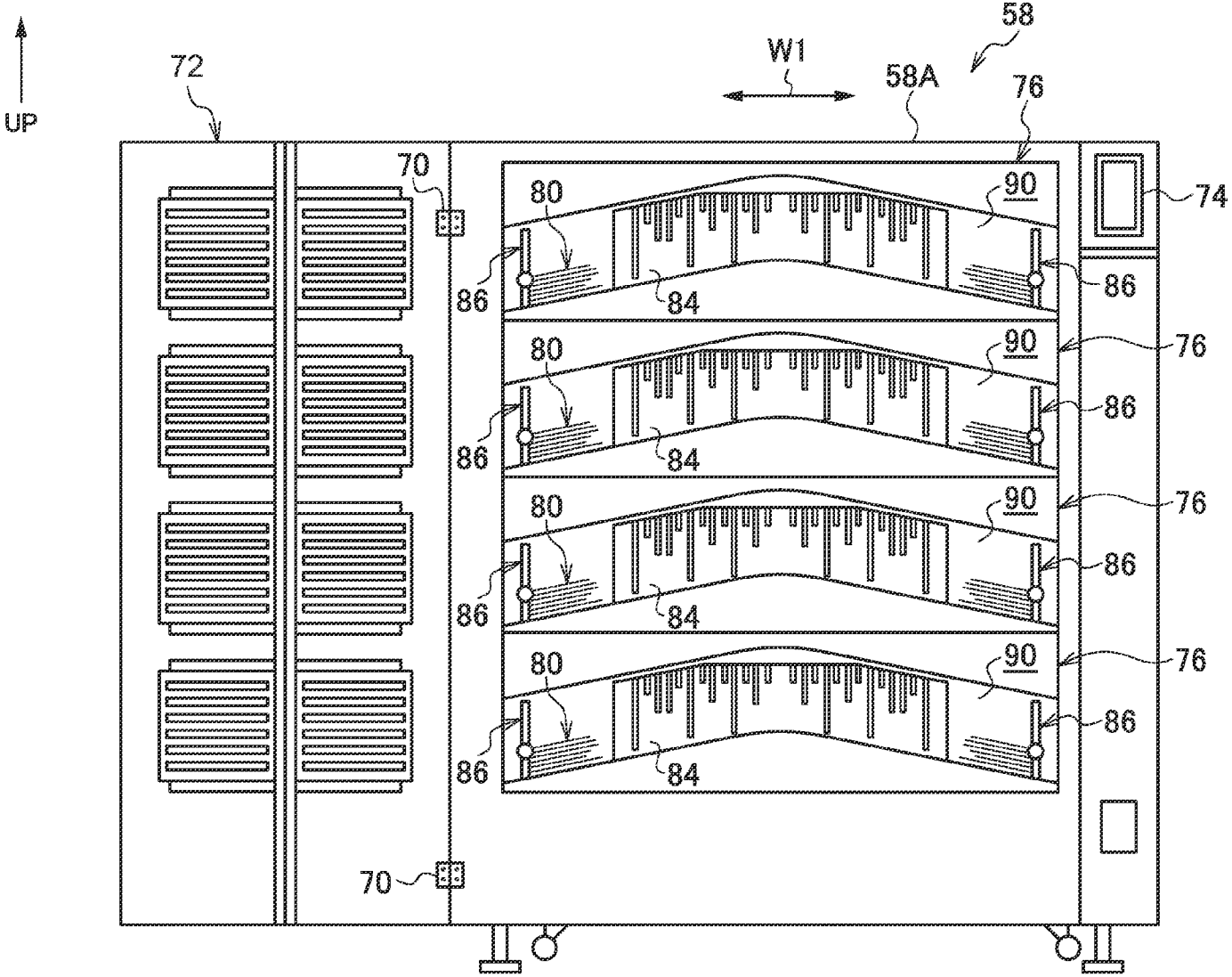
FIG. 5 is a front view showing the seasoning apparatus pertaining to the first embodiment of the present invention.

As shown in FIG. 5, the seasoning apparatus 58 is equipped with a housing 58A that is formed in a box-like shape. A front cover 72 that is supported by hinges 70 attached to one vertical edge of the housing 58A and is capable of being opened and closed from the front side of the seasoning apparatus 58 is disposed on the housing 58A. FIG. 5 shows a state where the front cover 72 is in an open position so that the inside of the housing 58A can be seen.

Further, a touch panel 74 for a user to operate the seasoning apparatus 58 is disposed in the neighborhood of the other vertical edge of the housing 58A located at an opposite side of the one vertical edge side where the hinges 70 are disposed. Moreover, plural (in the present embodiment, four) stacking shelf units 76 are disposed adjacent to each other in the vertical direction inside the housing 58A.

Further, the stacking shelf units 76 are supported by the housing 58A in such a way that, in a state where the front cover 72 has been opened, the stacking shelf units 76 can be slid to and pulled out from the front side (the near side of the page showing FIG. 5). In following description, when the phrase "width direction" is used, this will mean the width direction of the stacking shelf units 76 (the direction of arrow W1 in FIG. 5).

Figure 3:
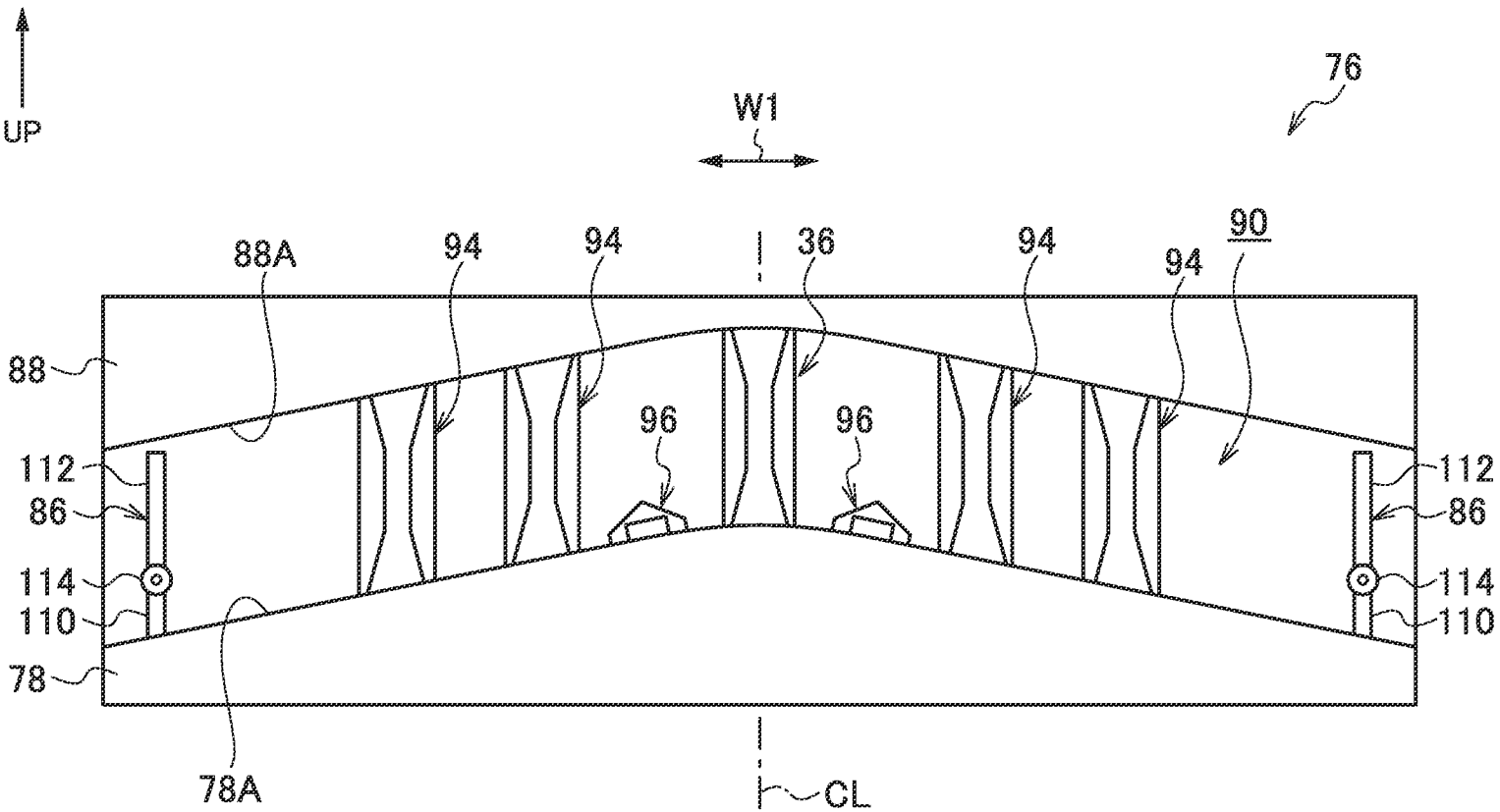
FIG. 3 is a front view showing the seasoning apparatus pertaining to the first embodiment of the present invention.
Figure 4:
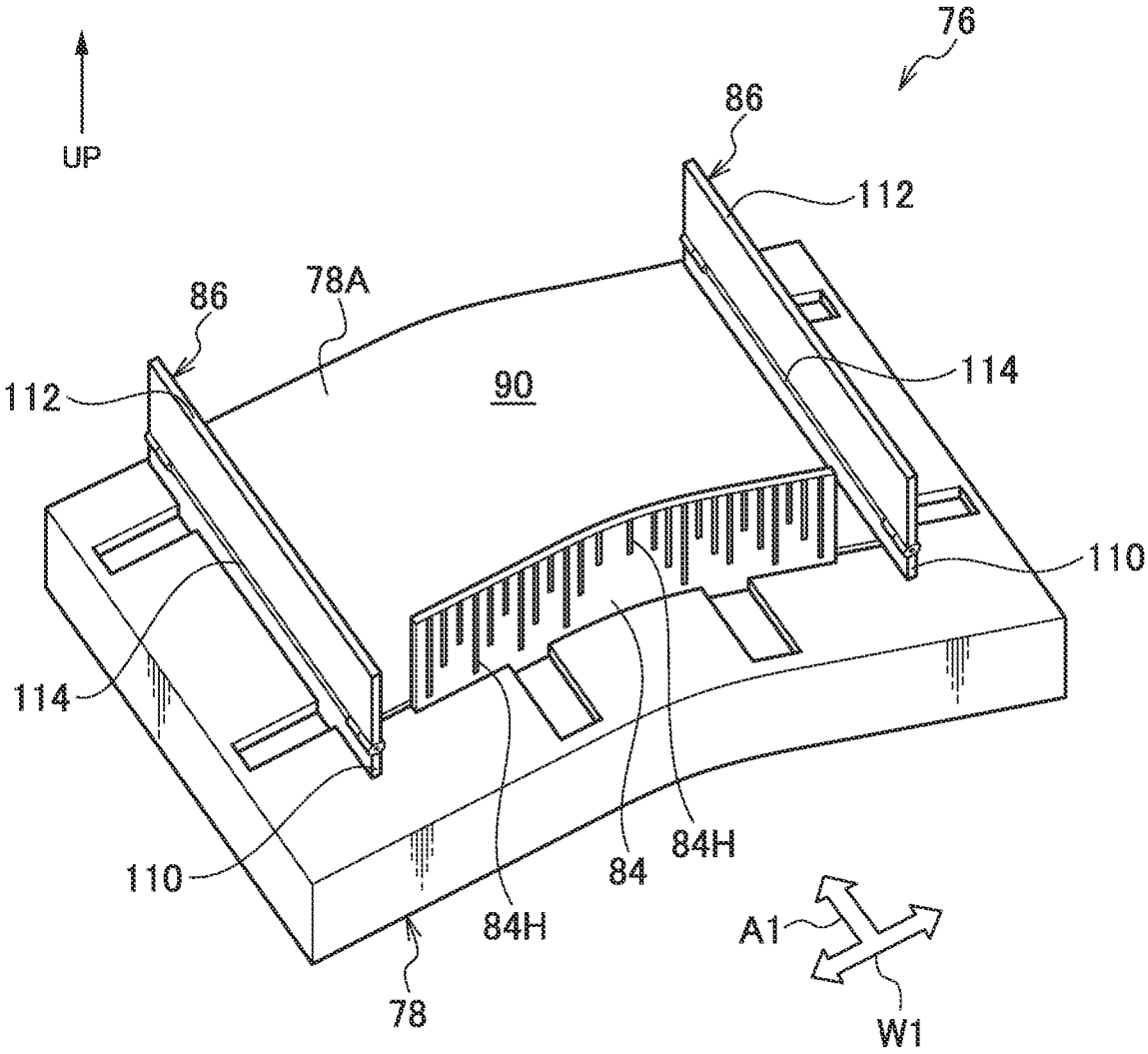
FIG. 4 is a perspective view showing a mount and so forth used in the seasoning apparatus pertaining to the first embodiment of the present invention.

As shown in FIG. 3 and FIG. 4, each of the stacking shelf units 76 is equipped with a mount 78. The upper surface of the mount 78 is a mounting surface 78A on which a paper sheet bundle 80 is mounted (see FIG. 5 and FIG. 8) in which a plurality of the paper sheets P are stacked.

In the present embodiment, as an example, the number of the paper sheets P that can be stacked in one of the stacking shelf units 76 is 125 sheets in the case of plain paper and 50 sheets in the case of thick paper which is thicker than the plain paper. As the thick paper, for example, paper with a grammage of 310 g/m$^2$ (trade name: Aibest) is used.

The mounting surface 78A curves in such a way that its width direction central portion is convex when seen in a first direction running from a front side toward a rear side of the apparatus 58, that is the direction corresponds to arrow A1 shown in FIG. 4. By causing the mounting surface 78A to curve in this way, for example, in a case where end regions in the direction of A1 of the paper sheets P on which images have been recorded in the image forming apparatus 10 curls, it becomes possible to perform curl correction by causing the paper sheets P to curve in a direction orthogonal to the curl direction.

A pair of right and left side panels 86 when seen in the first direction from the front side of the apparatus 58 are disposed on the mounting surface 78A of the mount 78 in such a way as to extend up in the vertical direction. A front panel 84 whose panel surface faces the front side is disposed between the pair of side panels 86. That is, the pair of side panels 86 support both end portions of the paper sheets P in the width direction of the stacking shelf units 76. The width direction intersects (in the present embodiment, is orthogonal to) the aforementioned first direction. Because of this, the end portions of the plural paper sheets P mounted on the mounting surface 78A of the mount 78 are aligned. Additionally, the front panel 84 is movable in the direction of arrow A1 and in the opposite direction of arrow A1, and the side panels 86 are movable in the direction of arrow W1. Thus, different sizes of the paper sheets P can be handled. Details in regard to the side panels 86 will be described below.

As shown in FIG. 3, in each of the stacking shelf units 76, a top panel 88 is disposed above the mount 78 in the vertical direction. A top surface 88A that is the undersurface of the top panel 88 is formed in the same curved shape as the mounting surface 78A when seen in the first direction. The top surface 88A opposes, across a gap, the uppermost paper sheet P of the paper sheet bundle 80 mounted on the mounting surface 78A.

Additionally, the region surrounded by the mounting surface 78A, the top surface 88A, the front panel 84, and the side panels 86 is a paper sheet bundle accommodating space 90.

As shown in FIG. 4, plural air discharge holes 84H are formed in the front panel 84. As described below, after air that has been sent from first blowing devices 94 and second blowing devices 96 serving as an example of a blowing member has passed between the paper sheets P, the air can escape from the paper sheet bundle accommodating space 90 through the air discharge holes 84H.

As shown in detail also in FIG. 3, plural (in the present embodiment, five) first blowing devices 94 and plural (in the present embodiment, two) second blowing devices 96 are placed on a back side of the mount 78 (the side where the front panel 84 is not placed). The first blowing devices 94 and the second blowing devices 96 act to cause the paper sheets P configuring the paper sheet bundle 80 to become accustomed (seasoned) to the surrounding environment by blowing the same air as the surrounding atmosphere (temperature and humidity) from the end portion of the paper sheet bundle 80 to the paper sheet bundle 80 mounted on the mounting surface 78A.

Figure 7B:
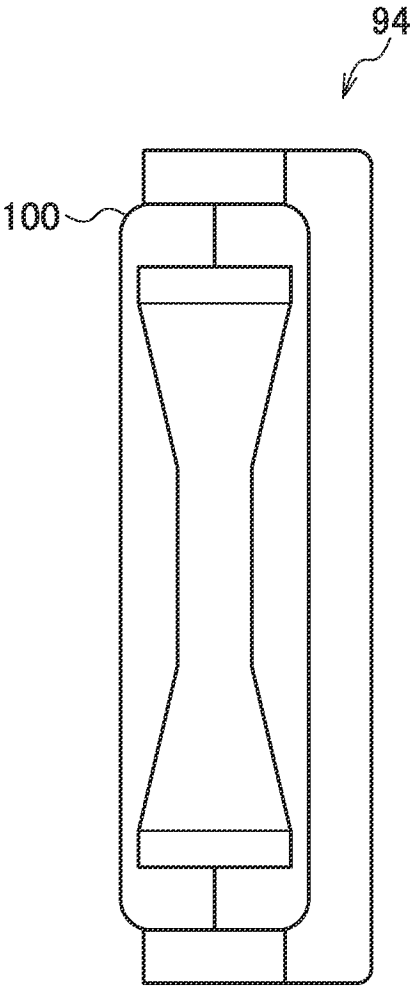
FIG. 7A and FIG. 7B are a side view and a front view, respectively, showing a first blowing device used in the seasoning apparatus pertaining to the first embodiment of the present invention.
Figure 7A:
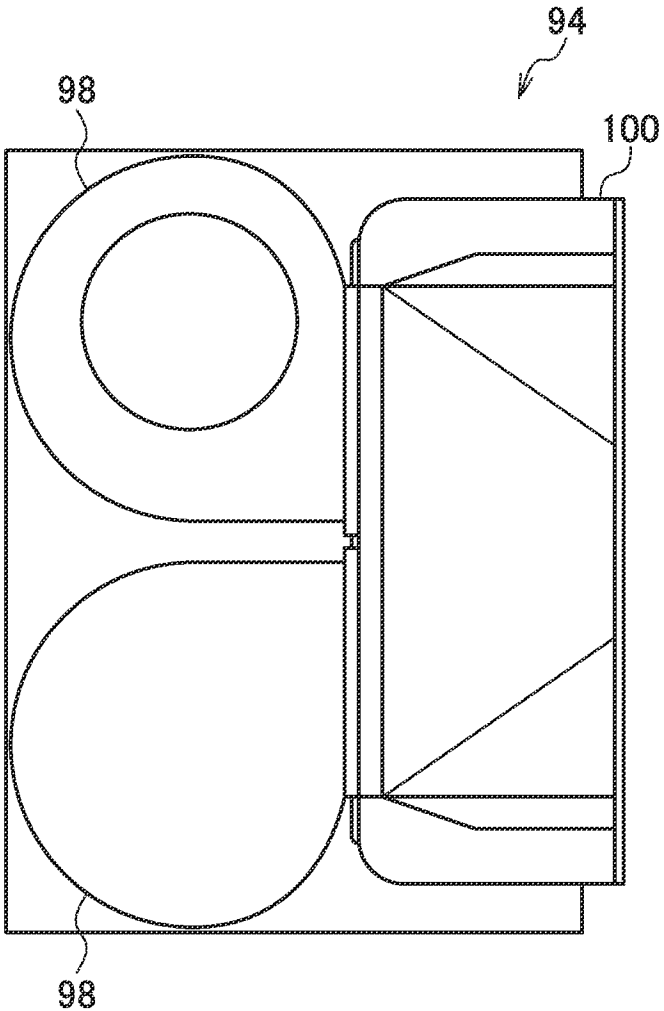

As shown in FIG. 7A and FIG. 7B, each of the first blowing devices 94 is equipped with two blowers 98 that are placed up and down and a duct portion 100 that guides the airflows that have been generated by the blowers 98. The duct portion 100 is disposed across upper and lower directions in the vertical direction. The first blowing devices 94 blow air across upper and lower directions in the vertical direction of the paper sheet bundle accommodating spaces 90.

Figure 6B:
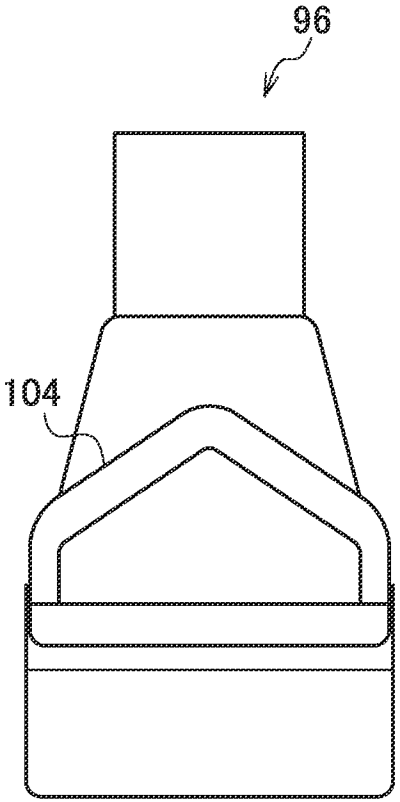
FIG. 6A and FIG. 6B are a side view and a front view, respectively, showing a second blowing device used in the seasoning apparatus pertaining to the first embodiment of the present invention.
Figure 6A:
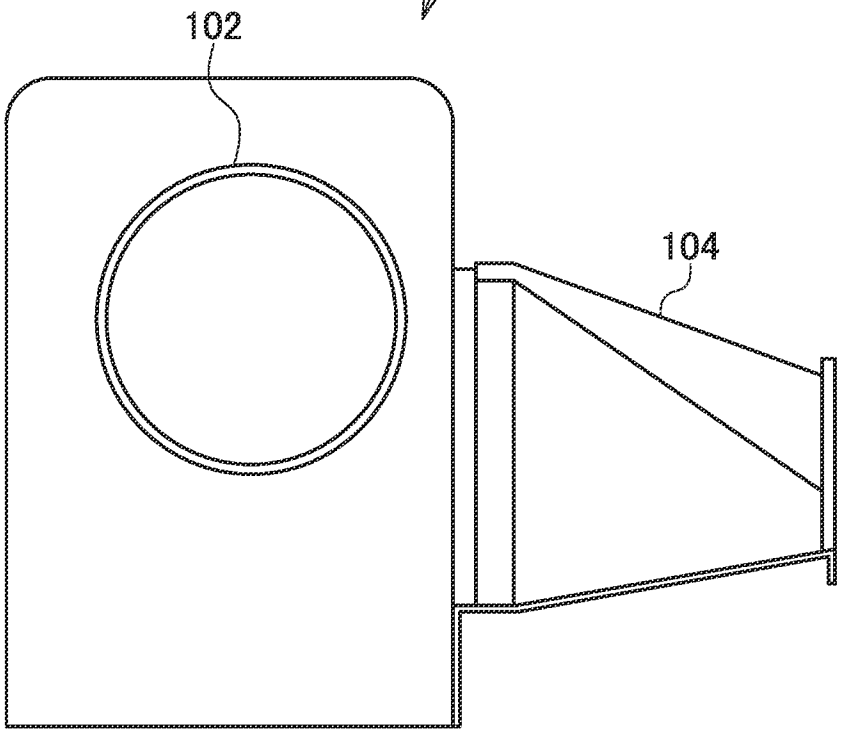

In contrast, as shown in FIG. 6A and FIG. 6B, each of the second blowing devices 96 has one blower 102 and a duct portion 104 that guides the airflow that has been generated by the blower 102. The duct portion 104 is disposed in the lower side in the vertical direction. The second blowing devices 96 are configured to blow air in the lower direction of the vertical direction of the paper sheet bundle accommodating spaces 90.

Next, the side panels 86 will be described in detail.

Figure 2A:
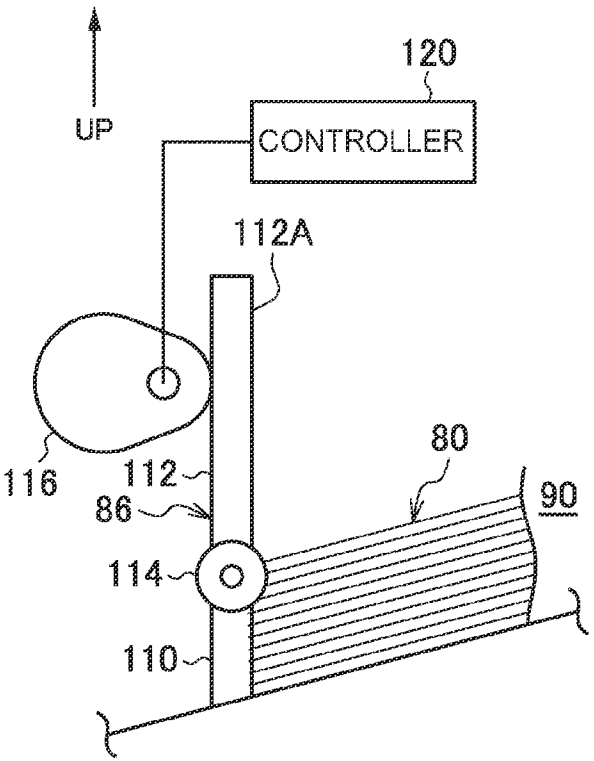
FIG. 2A, FIG. 2B, and FIG. 2C are front views showing a side panel and so forth used in the seasoning apparatus pertaining to the first embodiment of the present invention.
Figure 2B:
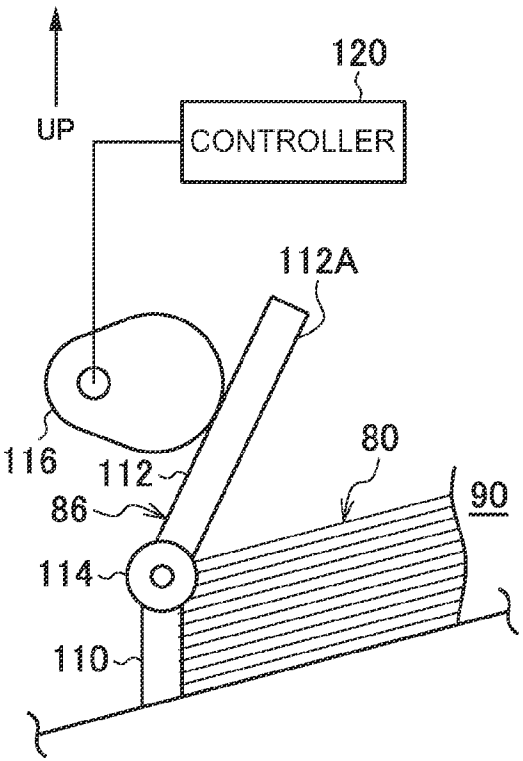
Figure 2C:
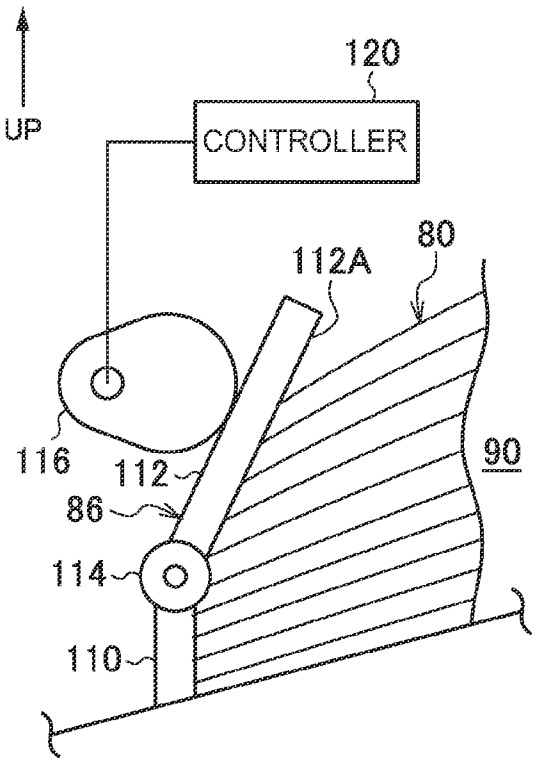

As shown in FIG. 2A, FIG. 2B, and FIG. 2C, each of the side panels 86 that extends upward in the vertical direction is equipped with a lower side panel 110 whose proximal end portion is fixed to the mounting surface 78A and an upper side panel 112 that is disposed above the lower side panel 110. Moreover, a hinge 114 that extends in the first direction of the stacking shelf units 76 is disposed between the lower side panel 110 and the upper side panel 112, and the upper side panel 112 is swingably supported on the lower side panel 110. The configurations of the pair of side panels 86 are mutually the same, so one of the side panels 86 will be described.

Moreover, an eccentric cam 116 is disposed in such a manner that its peripheral surface is in contact with the back surface of the upper side panel 112 (the surface that does not face the paper sheet bundle accommodating space 90). Further, a coil spring (not shown in the drawings) that presses the back surface of the upper side panel 112 against the peripheral surface of the eccentric cam 116 is disposed in the hinge 114. That is, the peripheral surface of the eccentric cam 116 supports the upper side panel 112.

Additionally, in a case where the minor diameter side of the eccentric cam 116 supports the upper side panel 112, the upper side panel 112 is placed in such a way as to extend up in the vertical direction so that the lower side panel 110 and the upper side panel 112 are placed in a straight line (see FIG. 2A).

On the other hand, in a case where the eccentric cam 116 rotates so that the major diameter side of the eccentric cam 116 supports the upper side panel 112, the upper side panel 112 swings and is placed in such a way as to incline toward the paper sheet bundle accommodating space 90 side with respect to the vertical direction (see FIG. 2B). That is, the surface of the upper side panel 112 that faces the paper sheet bundle accommodating space 90 is an inclining surface 112A that inclines with respect to the vertical direction.

Moreover, a controller 120 that controls the angle of inclination (the angle with respect to the vertical direction) of the inclining surface 112A by causing the eccentric cam 116 to rotate is disposed. Specifically, in a case where the thickness of the paper sheet P is thick, the controller 120 increases the angle of inclination of the inclining surface 112A compared to a case where the thickness of the paper sheet P is thin. In the present embodiment, as an example, in a case where the paper sheets P are plain paper, the controller 120 sets the angle of inclination of the inclining surface 112A to 0 degrees (see FIG. 2A), and in a case where the paper sheets P are thick paper (paper with a grammage of 310 g/m$^2$ (trade name: Aibest)), the controller 120 causes the eccentric cam 116 to rotate to thereby cause the inclining surface 112A to incline (see FIG. 2B).

As shown in FIG. 8, the paper sheet P on which images have been recorded is conveyed by the discharging drum 52 and are discharged from the image forming apparatus 10 via the guide plate 54. Thereafter, the paper sheet P is seasoned by the seasoning apparatus 58.

The paper sheets P may be sent one sheet at a time to the paper sheet accommodating spaces 90 in the seasoning apparatus 58 shown in FIG. 4, so that the paper sheet bundles 80 are configured as a result of plural paper sheets P being stacked inside the paper sheet bundle accommodating spaces 90. Alternatively, the paper sheet bundles 80 may be configured by plural paper sheets P in, for example, the discharging section 22 on the upstream side of the seasoning apparatus 58, and the paper sheet bundles 80 are thereafter sent as single units into the paper sheet bundle accommodating spaces 90 in the seasoning apparatus 58. Moreover, the paper sheet bundles 80 may also be set by manual work in the paper sheet bundle accommodating spaces 90 in the seasoning apparatus 58.

Here, as described above, in the present embodiment, the paper sheet bundle 80 includes 125 sheets in the case of plain paper and 50 sheets in the case of thick paper. When the paper sheet bundle 80 is set in the paper sheet bundle accommodating space 90, the controller 120 controls the rotation of the eccentric cams 116 in such a way that the angle of inclination of the inclining surfaces 112A is set to 0 degrees (see FIG. 2A).

Here, in a case where the user has inputted that the paper sheet bundle 80 to be accommodated in the paper sheet bundle accommodating space 90 is plain paper, the controller does not cause the eccentric cams 116 to rotate and maintains the angle of inclination of the inclining surfaces 112A to 0 degrees as shown in FIG. 2A.

On the other hand, in a case where the user has inputted that the paper sheet bundle 80 to be accommodated in the paper sheet bundle accommodating space 90 is thick paper, after the paper sheet bundle 80 has been accommodated, the controller 120 causes the eccentric cams 116 to rotate to thereby cause the inclining surfaces 112A to incline toward the paper sheet bundle accommodating space 90 side as shown in FIG. 2B.

Figure 1B:
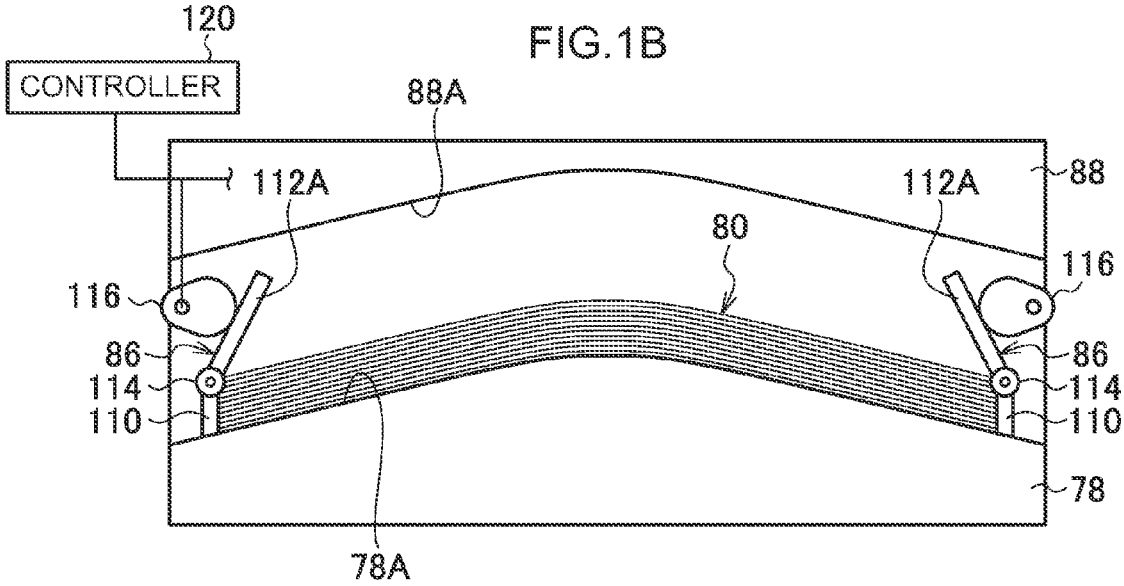

Specifically, as shown in FIG. 1A and FIG. 1B, in a case where the user has inputted that the paper sheet bundle 80 to be accommodated in the paper sheet bundle accommodating space 90 is thick paper, after the paper sheet bundle 80 has been accommodated, the controller 120 causes the eccentric cams 116 to rotate to thereby cause the inclining surfaces 112A to incline toward the paper sheet bundle accommodating space 90 side.

Then, with respect to the paper sheet bundle 80 in the paper sheet bundle accommodating space 90, the first blowing devices 94 and the second blowing devices 96 blow air toward the end surface of the paper sheet bundle 80.

Figure 1C:
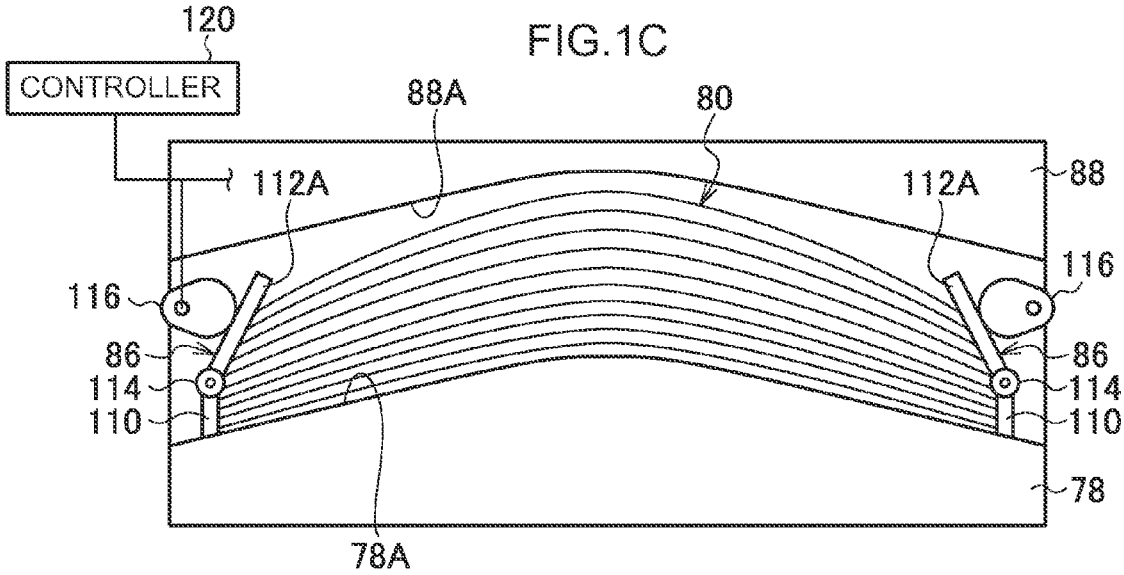

As shown in FIG. 1C, when air is blown onto the end surface of the paper sheet bundle 80 by the first blowing devices 94 and the second blowing devices 96, the loaded paper sheets P become raised. Additionally, the end portions in the width direction of the raised paper sheets P are pressed by the inclining surfaces 112A. Because the end portions of the raised paper sheets P are pressed by the inclining surfaces 112A, the raised paper sheets P bend in such a manner that their center portions become convex when seen from the front side of the stacking shelf units 76. Because of this, gaps through which the air is sent are formed between the paper sheets P.

That is, in a case where the paper sheets P are thick paper, it is thought that the paper sheet P accommodated at the upper side in the paper sheet bundle accommodating space 90 will be taut between the pair of side panels 86, and that gaps will not arise between the paper sheets P, because the load of the weight from the other paper sheets P is small. However, the end portions of the paper sheets P that have been raised as a result of air being blown thereon are pressed by the inclining surfaces 112A, the taut paper sheets P bend in such a manner that their center portions become convex when seen from the front side of the stacking shelf units 76, and gaps through which the air is sent are formed between the paper sheets P.

Because of this, the air passes between the plural paper sheets P, and the paper sheets P become accustomed (seasoned) to the surrounding environment. Particularly in a case where water-based ink has been used to perform image recording on general-purpose paper, the paper is apt to expand and contract because of differences in moisture content based on contrasting densities (large and small ink quantities) in the region where the image has been recorded (the region where the ink adheres). However, in the paper sheet seasoning apparatus 58 of the present embodiment, expansion and contraction of the paper sheets P is suppressed by effectively seasoning the paper sheets P.

For example, in the case of performing image recording on both surfaces of the paper sheet P, image recording is performed on one surface (the front surface) and thereafter image recording is performed on the other surface (the back surface), but even if the paper sheet P was expanded and contracted immediately after performing image recording on the front surface, image recording is performed on the back surface in a state where expansion and contraction has been eliminated (or a state where there is less expansion and contraction) by the seasoning, so deviations in the sizes and deviations in the positions of the recorded images on the front surface and the back surface are suppressed.

Further, even in the case of performing image recording only on one surface of the paper sheet P, the rippling phenomenon (so-called cockles) that accompanies the expansion and contraction of the paper sheet P is suppressed, so the image quality of the recorded images can be improved. Even in the case of administering processing such as bookbinding after image recording, the workability of the processing is excellent.

As described above, in a case where the paper sheets P accommodated in the paper sheet bundle accommodating space 90 are thick paper, the inclining surfaces 112A are inclined and the end portions of the paper sheets P that have been raised by the air are pressed by the inclining surfaces 112A, whereby gaps through which the air is sent are formed between the paper sheets P and the air can be effectively sent between the paper sheets P.

Further, because the air is effectively sent between the paper sheets P, the paper sheets P can be caused to become accustomed (seasoned) to the surrounding environment.

Further, the mounting surface 78A curves in such a way that its width direction central portion is convex when seen from the front side of the stacking shelf units 76. Even in a case where curling of the paper sheets P is strong, the surfaces of the paper sheet end portions in the blowing direction (the first direction) can be regulated to be flat with respect to the blowing direction, and the ability of the air to pass between the paper sheets P can be stabilized.

Further, in a case where the paper sheets P are plain paper, the controller 120 does not cause the inclining surfaces 112 to incline (the angle of inclination is 0 degrees), so the number of the paper sheets P accommodated in the paper sheet bundle accommodating space 90 can be increased compared to thick paper.

The present invention has been described in detail in regard to a particular embodiment, but the present invention is not limited to this embodiment, and it will be apparent to those skilled in the art that various other embodiments are possible in the scope of the present invention. For example, in the above-described embodiment, the inclining surfaces 112A are caused to incline when using thick paper, but the inclining surfaces may also be caused to incline incrementally depending on the type (grammage) of thick paper.

Further, in the above-described embodiment, the angle of inclination of the inclining surfaces 112A was changed by controlling the angle of rotation of the eccentric cams 116, but the user may also manually swing the upper side panels to cause the inclining surfaces to incline.

Further, in the above-described embodiment, the upper side panels 112 were caused to incline, but the entire side panels 86 may also be caused to incline.

Next, an example of a seasoning apparatus 58 and an image forming apparatus 10 pertaining to a second embodiment of the present invention will be described in accordance with FIG. 9A and FIG. 9B. Arrow UP in the drawings indicates up in a vertical direction.

Figure 9A:
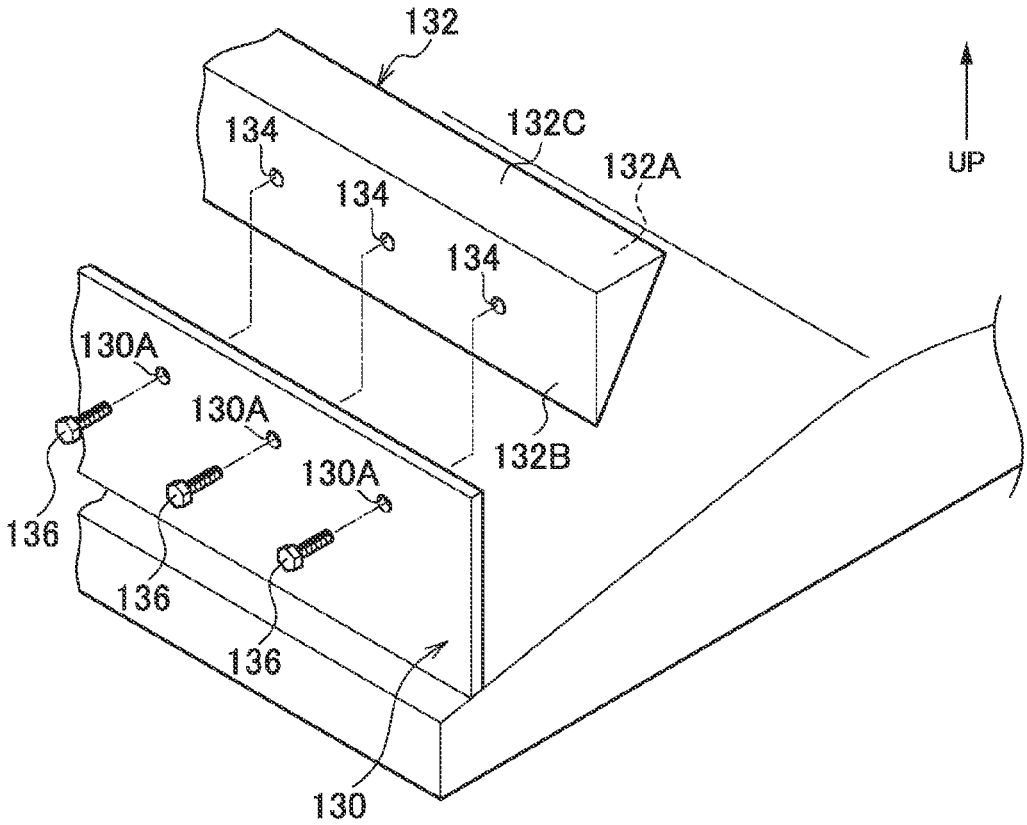
FIG. 9A and FIG. 9B are perspective views showing a side panel and so forth used in a seasoning apparatus pertaining to a second embodiment of the present invention.
Figure 9B:
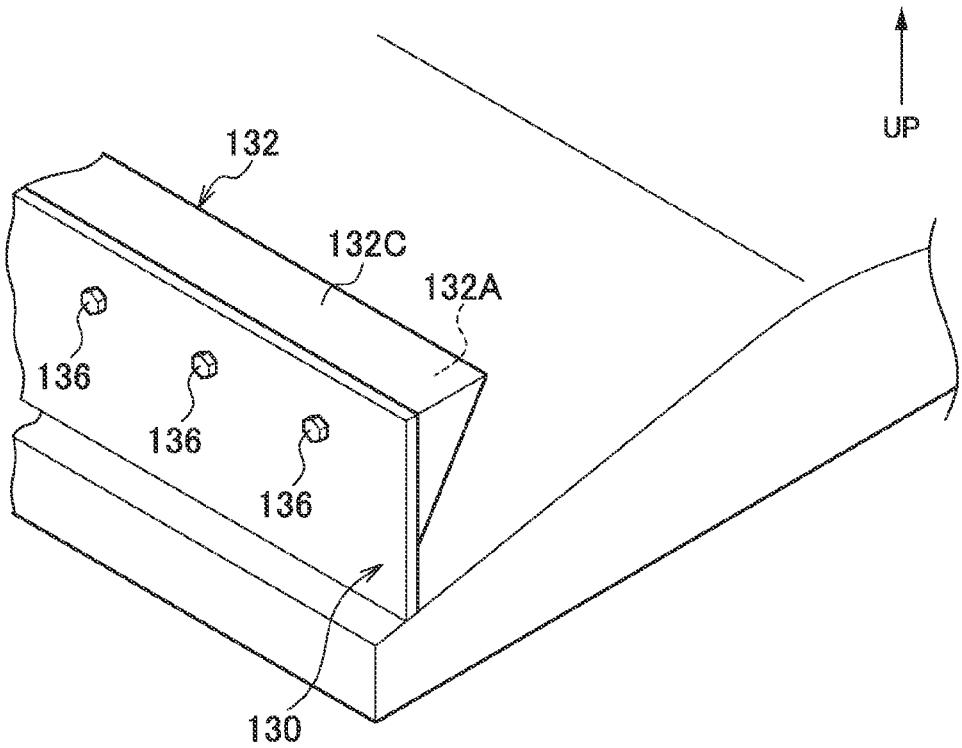

As shown in FIG. 9A and FIG. 9B, hinges are not disposed in side panels 130. Further, inclining surfaces 132A are formed by attachable-and-detachable members 132 that are disposed attachably to and detachably from the side panels 130.

Specifically, each of the attachable-and-detachable members 132 is formed in a triangular prism shape extending in the first direction (the front and back direction of the stacking shelf units 76) and is equipped with a back surface 132B that is attached to the side panel 130, a top surface 132C that faces up in the vertical direction, and the aforementioned inclining surface 132A.

Additionally, plural attachment holes 134 lined up in the first direction are formed in the back surface 132B. Moreover, through holes 130A penetrate the side panel 130 in such a way as to correspond to the attachment holes 134.

Further, plural bolts 136 that become fastened in the attachment holes 134 through the through holes 130A are disposed. That is, the bolts 136 are inserted through the through holes 130A and attached to (fastened in) the attachment holes 134, whereby the attachable-and-detachable member 132 is attached to the side panel 130.

In this way, the inclining surface 132A is formed by the attachable-and-detachable member 132. The attachable-and-detachable member 132 can be attached to the side panel 130 as needed.

The present invention has been described in detail in regard to a particular embodiment, but the present invention is not limited to this embodiment, and it will be apparent to those skilled in the art that various other embodiments are possible in the scope of the present invention. For example, in the above-described embodiment, the flat surface of the upper side panel 112 facing the paper sheet bundle accommodating space 90 was used as the inclining surface, but the surface of the upper side panel 112 facing the paper sheet bundle accommodating space 90 is not particularly limited to a flat surface and may also be a curved surface or a stepped surface or the like.

What is claimed is:

1. A paper sheet seasoning apparatus comprising:

a mount on which a plurality of sheet-like recording media on which images have been formed are loaded and whose central portion is curved in a convex shape when seen in a first direction;

a blowing member that blows air in the first direction onto end portions of the recording media loaded on the mount;

a pair of side panels that support both end portions, in a direction that intersects the first direction, of the recording media loaded on the mount; and a top panel that is disposed in such a way that a gap exists in a vertical direction between the top panel and an uppermost recording medium loaded on the mount, wherein on at least one of the pair of side panels, there is disposed an approaching surface that approaches the opposing side panel as the approaching surface heads upward in the vertical direction.

2. The paper sheet seasoning apparatus according to claim 1, wherein the approaching surface is disposed on each of the pair of the side panels.

3. The paper sheet seasoning apparatus according to claim 1, wherein the approaching surface is an inclining surface that inclines with respect to the vertical direction.

4. The paper sheet seasoning apparatus according to claim 3, wherein the angle of inclination of the inclining surface is adjustable.

5. The paper sheet seasoning apparatus according to claim 4, further comprising a controller that controls the angle of inclination of the inclining surface on the basis of the thickness of the recording media.

6. The paper sheet seasoning apparatus according to claim 5, wherein in a case where the thickness of the recording media is thick, the controller increases the angle of inclination of the inclining surface compared to a case where the thickness of the recording media is thin.

7. The paper sheet seasoning apparatus according to claim 3, wherein the inclining surface is disposed on an upper side of the side panel in the vertical direction.

8. The paper sheet seasoning apparatus according to claim 3, wherein the inclining surface is formed on an attachable-and-detachable member that is disposed in such a way as to be attachable to and detachable from the side panel.

9. An image forming apparatus comprising:

an image recording section that forms images on recording media; and the paper sheet seasoning apparatus according to claim 1 that receives the recording media on which images have been formed in the image recording section.

* * * * *